US005524307A

United States Patent [19]

Griffin

[11] Patent Number: 5,524,307

[45] **Date of Patent: * Jun. 11, 1996**

[54] BODY SUPPORT ARRANGEMENT

[76] Inventor: Gordon D. Griffin, P.O. Box 171, Tasmania, 7310, Australia

[ * ] Notice: The portion of the term of this patent subsequent to Jun. 18, 2003, has been disclaimed.

[21] Appl. No.: 777,313

[22] Filed: Sep. 18, 1985

[51] Int. Cl.[6] ..... A47C 27/10; A47C 23/06

[52] U.S. Cl. ..... 5/455; 5/236.1; 5/241

[58] Field of Search ..... 5/236 R, 236 B, 5/237–242, 420, 423, 449–458, 461, 462, 468, 469, 473, 495, 481

[56] References Cited

U.S. PATENT DOCUMENTS

| | | | |
|---|---|---|---|
| 211,264 | 1/1879 | Schmidt | 5/239 |
| 1,981,666 | 11/1934 | Ridley | 5/453 |
| 3,683,431 | 8/1972 | Pennel et al. | 5/458 |
| 3,798,686 | 3/1974 | Gaiser | 5/450 |
| 4,057,861 | 11/1977 | Howorth | 5/468 |
| 4,477,935 | 10/1984 | Griffin | 5/241 |
| 4,525,886 | 1/1985 | Savenije | 5/464 |

FOREIGN PATENT DOCUMENTS

| | | | |
|---|---|---|---|
| 60277 | 3/1926 | France | 5/238 |
| 2621803 | 6/1977 | Germany | 5/236.1 |

*Primary Examiner*—Alexander Grosz

[57] ABSTRACT

A body support arrangement comprising a pair of flexible elongate tubes (12) forming air springs located in spaced parallel relationship by stabilizer members (14) which space and impart lateral stability to the tubes (12). A body support surface is formed by a series of slats (20) extending transversely of and resting on the tubes (12). The slats (20) are fixedly attached, for example by adhesive, to a flexible sheet (22).

12 Claims, 1 Drawing Sheet

Fig. 1
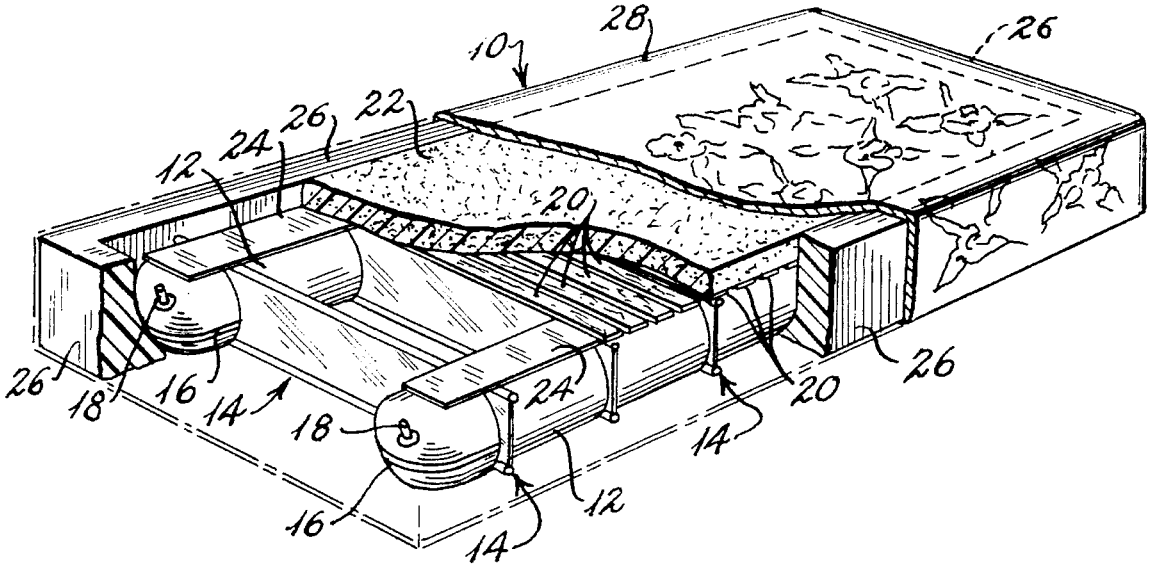
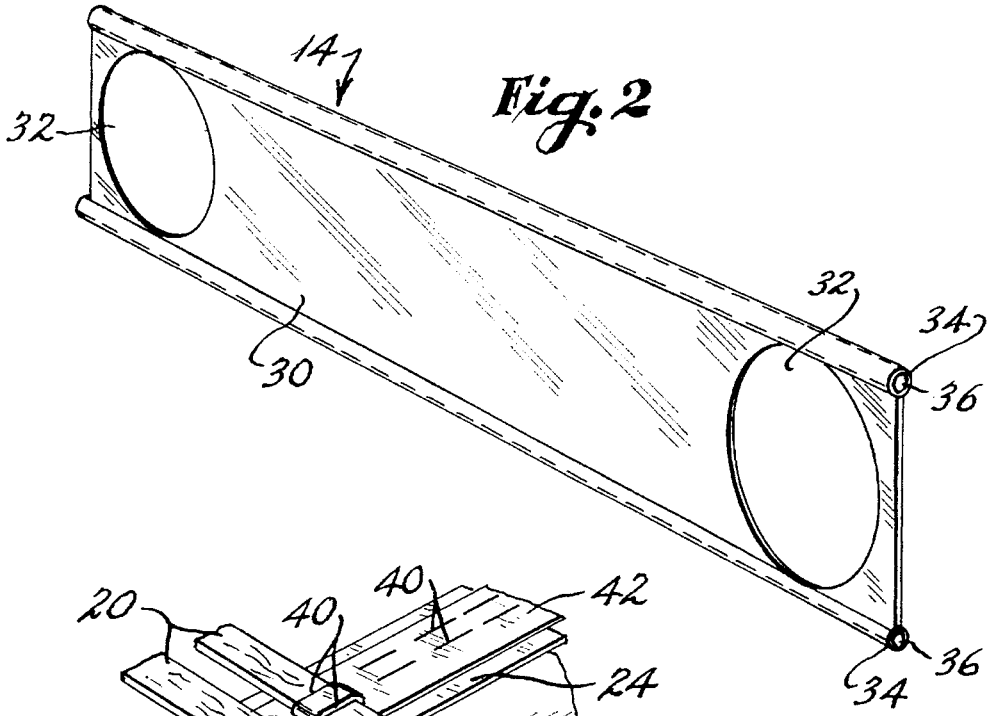
Fig. 2
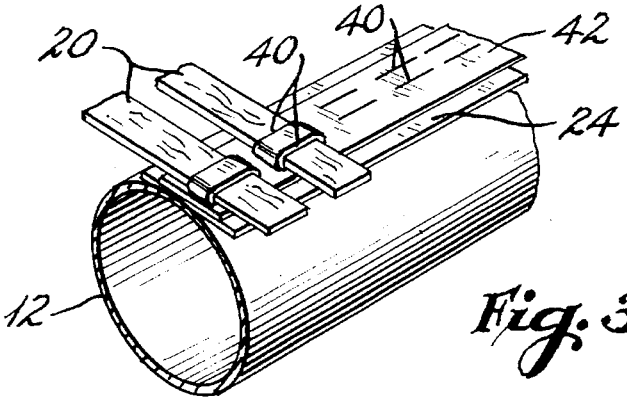
Fig. 3

BODY SUPPORT ARRANGEMENT

BRIEF DESCRIPTION OF THE INVENTION

1. Field of the Invention

This invention relates to a support system for mattresses or cushions in beds, chairs, sofas, settees, stretchers and other body support appliances.

This invention is particularly applicable to support systems wherein a mattress or cushion rests on slats extending between supporting air springs as disclosed in my U.S. Pat. No. 4,477,935 and granted European Patent No. 038155 and European Application No. 8423810

2. Objects of the Invention

The object of the present invention is to provide a more economically manufactured support system that is disclosed and claimed in my aforementioned patents and applications for patents.

3. Features of the Invention

The present invention comprises a support system including at least a pair of flexible elongate tubes forming air springs, maintained in spaced parallel relationship by members which effect the required spacing and that impart lateral stabililty to said tubes and a body support surface formed by a series of members extending transversely of and resting on said tubes, said body support members being fixedly attached to flexible material. Means preferably in the form of resilient end blocks provide peripheral mattress support and fixedly attached flexible material and all components are preferably enclosed within a cover providing ready access to air filler tubes for the user.

Other objects and features of the invention will become apparent from the following detailed description and drawing disclosing what are presently contemplated as being the best modes of the invention.

THE DRAWING

In the drawing:

FIG. 1 is a perspective view partly in cut-away section of a body support system according to the present invention.

FIG. 2 is a perspective view, of a spacer and lateral stabilizer used in the system shown in FIG. 1, and FIG. 3 is a modification of the system shown in FIG. 1.

Referring now to the drawings:

As best seen in FIG. 1 of the drawings, a body support system, shown generally at 10, comprises a pair of elongate flexible tubes 12 forming air springs which are spaced apart in parallel with one another, a required predetermined distance by spacer members 14 positioned longitudinally along the tubes 12. As will be hereinafter described, in addition to spacing the tubes 12, the spacer members 14 also maintain lateral stability of the tubes while allowing vertical displacement.

Each tube 12 is formed of heat welded sheet or extruded plastics material and the end of each tube is closed by heat welds 16 with an air pressure control valve 18 in the upper portion thereof and adjacent a foot end of the tube.

A series of independent, transversely extending mattress or body support members in the form of slats 20 are fixed in closely spaced parallel relationship to the underside of a flexible foam or other sheet material 22, by, for example, an adhesive or by a hook and nap fabric fastener, such as "Velcro" (RTM) material. The end portions of the slat 20 lie on the spaced tubes 12, preferably with a vinyl wear strip 24 interposed therebetween. Conveniently the vinyl strips 24 may be attached by adhesive to the slats 20 after the latter have been fixed to the sheet 22. It will be appreciated that the showing of the slats 20 in the forward position of FIG. 1 have been omitted for the sake of clarity.

The ends and sides of the assembly are formed respectively by elongated blocks of material 26 having a higher impact load resistance, i.e. they have a higher resistance to compressibility than the plastics foam material 22. Preferably the inner wall of the blocks 26 is bevelled as shown in FIG. 1 to provide additional support for the tubes 12. The assembly is encapsulated in a cover 28 provided with an opening which extends along one side and both ends blocks, the opening being closed by a sliding clasp fastener (not shown). When the opening is closed the runner of the fastener is at the foot end of the cover so that sliding the runner to open the cover at the foot-end will provide easy access at the foot of the support system to the valves 18.

As shown in FIG. 2, each spacer member 14 comprises a single membrane 30 of sheet plastics material. The membrane 30 is of a length slightly greater than the overall spacing between the tubes 12 and is provided with spaced apertures 32 whose axes correspond with the respective axes of the tubes. The diameter of the apertures 32 is slightly less than the diameter of the inflated tubes 12 to provide a gripping action when the spacer member is mounted thereon. The upper and lower edges of the membrane 30 are formed, respectively, with a sleeve 34, each accommodating a rod 36, which extends from one end of the membrane 30 to the other.

It will be readily appreciated that the spacer members 14 may take other forms. For example, a spacer member may be formed by an open-ended flattened tubular member of sheet plastics material with the rods 36 replaced by slats similar to the slats forming the support surface. With this arrangement, when positioned on the tubes 12, the spacer member cross-section is of rectangular configuration.

The use of spacer members 14 as described above enables the tubes 12 to be maintained at the required spacing even though the members 14 are deformed vertically due to a load being applied on the slats 20. Additionally, the rods 36 ensure lateral stability of the assembly. Any desired number of spacer members 14 may be used but, in general, up to five or six single membrane units are sufficient to ensure lateral stability of the tubes 12 depending on the use and manufacturing design.

In an alternative form of the invention as shown in FIG. 3, the slats 20, instead of being fixedly connected to the foam material 22, may have their respective end portions releasably secured in pairs of aligned slits 40 formed in flexible strips of material 42, the latter being in contact with the vinyl strip 24 or fixed to the tube 12 by adhesive. In a further construction the extremities of the slats are received in pockets formed in the facing side walls of a pair of spaced flexible strips. These latter methods might be more appropriate for Eastern style living where lightweight independent mattresses are used such as the traditional Japanese Futons. The valves, and blocks and cover used with this embodiment are not shown further in detail since they are the same as disclosed in connection with the embodiment of FIG. 1.

Although a preferred form of my invention has been herein disclosed, it is to be understood that the present disclosure is by way of example and that variations are possible without departing from the subject matter coming within the scope of the following claims, which subject matter I regard as my invention.

I claim:

1. A body support system comprising a pair of like flexible elongate air filled tubes forming air springs maintained in spaced parallel relationship by stabilizer members, said stabilizer members each comprising a membrane having rods extending length wise, respectively along its upper and lower portions, each stabilizer member having spaced apertures through which the air filled tubes are inserted to tightly fit therein, and impart lateral stability to said tubes and a body support surface formed by a series of spaced apart, parallel body support members extending transversely of and resting on said air filled tubes, said body support members being fixedly attached to a flexible member, said stabilizer members extending substantially parallel to the body support members.

2. A support system as claimed in claim 1, wherein said body support members are attached to a sheet of foam material.

3. A support system as claimed in claim 1, wherein end portions of the body support members are retained in flexible strip material resting on said tubes.

4. A support system as claimed in claim 3, wherein said strip material is connected to said tubes.

5. A support system as claimed in claim 1, wherein a strip of wear-resistant material is interposed between said body support members and said tubes.

6. A support system as claimed in claim 1, wherein blocks of flexible material having a high impact load resistance, are provided to extend along outsides of the tubes and across said tube ends.

7. A support system as claimed in claim 6, whereby the blocks at the ends of the tubes and a cover prevent migration of the body support member and affixed flexible members relative to the tubes.

8. A support system as in claim 1, wherein the tubes and stabilizer members are formed of plastics material.

9. A support system as in claim 1, wherein the body support members rest on the tubes and are fixed to a sheet of foam material on a side of said members opposite said tubes.

10. A support system as in claim 9, wherein the body support members are permanently affixed to the sheet of foam.

11. A support system as in claim 9, wherein the body support members are releasably affixed to the sheet of foam.

12. A body support appliance comprising a pair of like flexible elongate air filled tubes forming air springs maintained in spaced parallel relationship by stabilizer members, each stabilizer member including sleeves formed respectively, along its upper and lower portions to accommodate rods fitted therethrough, the stabilizing members having a narrow rectangular configuration, each stabilizer member having spaced apertures through which the air filled tubes are inserted to tightly fit therein and impart lateral stability to said tubes and a body support surface formed by a series of spaced apart parallel body support members extending transversely of and resting on said air filled tubes, said body support members being fixedly attached to a flexible member said stabilizer member extending substantially parallel to the body support members.

* * * * *